US009597886B2

(12) United States Patent
Wong et al.

(10) Patent No.: US 9,597,886 B2
(45) Date of Patent: Mar. 21, 2017

(54) PRINTER INK CARTRIDGES

(71) Applicant: Hewlett-Packard Development Company, L.P., Houston, TX (US)

(72) Inventors: Yeang Chyn Wong, Singapore (SG); Sittampalam Paranan, Singapore (SG); Djuhartini Tandjo, Singapore (SG); Boon Huey Yap, Singapore (SG); Soo Leng Teo, Singapore (SG); Ngee Hong Richard Lim, Singapore (SG); Ping Siew Kwok, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/025,643

(22) PCT Filed: Sep. 30, 2013

(86) PCT No.: PCT/US2013/062551

§ 371 (c)(1),
(2) Date: Mar. 29, 2016

(87) PCT Pub. No.: WO2015/047370

PCT Pub. Date: Apr. 2, 2015

(65) Prior Publication Data

US 2016/0229192 A1 Aug. 11, 2016

(51) Int. Cl.
*B41J 2/175* (2006.01)

(52) U.S. Cl.
CPC ..... *B41J 2/17553* (2013.01); *B41J 2/175* (2013.01); *B41J 2/17509* (2013.01); *B41J 2/17513* (2013.01); *B41J 2/17556* (2013.01)

(58) Field of Classification Search
CPC .... B41J 2/175; B41J 2/17503; B41J 2/17509; B41J 2/17513; B41J 2/1752; B41J 2/1754; B41J 2/17553; B41J 2/17556
See application file for complete search history.

(56) References Cited

U.S. PATENT DOCUMENTS 5,847,735 A 12/1998 Betschon
6,220,701 B1 * 4/2001 Umemura ..... B41J 2/17513 347/86

(Continued)

FOREIGN PATENT DOCUMENTS

KR 102003002813 4/2003
WO WO-2009136928 11/2009

OTHER PUBLICATIONS

Hui et al., "Effects of Loading and Air Bag Bracing Patterns on Correlated Relative Air Distribution Inside Refrigerated Semi-Trailers Transporting Fresh Horticultural Produce," vol. 50, 2008, Canadian Biosystems Engineering, 9 p.

(Continued)

*Primary Examiner* — Anh T. N. Vo

(74) *Attorney, Agent, or Firm* — HP Inc. Patent Department

(57) ABSTRACT

A printer cartridge is disclosed that is under negative pressure to retain liquid and allows controlled ingress of atmospheric air to release liquid from the printer cartridge. A labyrinth on a surface of the printer ink cartridge provides controlled ingress of atmospheric air having an entrance chamber to allow entry of atmospheric air, an exit chamber in communication with the liquid, and an elongate channel extending between the entrance chamber and the exit chamber. The elongate channel having a raised track formed on the surface and extending along each side of the elongate channel.

15 Claims, 3 Drawing Sheets

(56) References Cited

U.S. PATENT DOCUMENTS

| | | | | |
|---|---|---|---|---|
| 6,264,316 | B1 * | 7/2001 | Chino | B41J 2/175 347/86 |
| 6,283,587 | B1 * | 9/2001 | Umemura | B41J 2/17533 347/86 |
| 6,350,026 | B1 | 2/2002 | Lin | |
| 6,739,711 | B2 | 5/2004 | Lee et al. | |
| 7,387,379 | B2 * | 6/2008 | Nanjo | B41J 2/17513 347/86 |
| 8,002,398 | B2 | 8/2011 | Pearson et al. | |
| 9,308,732 | B2 * | 4/2016 | Chua | B41J 2/17513 |
| 2006/0232649 | A1 | 10/2006 | Wu et al. | |
| 2007/0139492 | A1 | 6/2007 | Anderson, Jr. et al. | |
| 2011/0122208 | A1 | 5/2011 | Myers et al. | |

OTHER PUBLICATIONS

PCT International Search Report and Written Opinion, Jun. 26, 2014, PCT Patent Application No. PCT/US2013/062551, Hewlett-Packard Development Company, L.P., Korean Intellectual Property Office, 13 pages.

* cited by examiner

PRINTER INK CARTRIDGES

CROSS-REFERENCE TO RELATED APPLICATION

This application is a U.S. National Stage Application of and claims priority to International Patent Application No. PCT/US2013/062551, filed on Sep. 30, 2013, and entitled "PRINTER INK CARTRIDGES," which is hereby incorporated by reference in its entirety.

BACKGROUND

This disclosure concerns printer ink cartridges that allow controlled ingress of atmospheric air to release liquid ink from the printer ink cartridge. Commonly, negative pressure within the cartridge is provided by foam that is vented to atmosphere via a labyrinth. In some cases, before the cartridge is used for the first time a removable cover is peeled away to open an entrance chamber to atmospheric air to allow air to flow through the labyrinth.

BRIEF DESCRIPTION OF THE DRAWINGS

By way of non-limiting examples, a printer ink cartridge according to the present disclosure will be described with reference to the following drawings (not to scale), in which.

DETAILED DESCRIPTION

The present disclosure describes a printer cartridge that has a chamber under negative pressure to retain liquid. Herein a negative pressure may be provided by capillary channels inside of capillary material that is present in the chamber. The cartridge allows controlled ingress of atmospheric air to release liquid from the cartridge. The controlled ingress of atmospheric air is provided by a labyrinth on the surface of the printer cartridge that is facing upwards in normal use of the cartridge. The labyrinth has an entrance chamber to allow entry of atmospheric air, an exit chamber in communication with the liquid, and an elongate channel extending between the entrance chamber and the exit chamber. The elongate channel has a raised track extending along each side of the elongate channel. The printer cartridge may include a cover to hermetically seal the labyrinth including sealing with the raised track.

The raised track provides a raised surface area that may facilitate better adhesion with the cover, to provide for a relatively tight seal with the cover even when accounting for variances the plastic moulding process that may result in variation in the topography of the labyrinth.

Adhesion islands are raised areas on the surface of the printer cartridge that facilitate greater adhesion in those areas. In an example, a junction defining a removable part of the cover and a permanent part of the cover is positioned between first and second adhesion islands. In this way intentionally the adhesion of the cover is greater in this area compared to other surface areas of the cartridge. In an example, this provides a wide tolerance in the position of a tear line in the cover of the junction. In an example the cover is to part along the tear line when it is peeled, and is not to open the lower part of the labyrinth to atmospheric air. Since the adhesion islands are separate from the raised track, the features of the printer cartridge lid that are provided to control the peel strength can be separated from the features provided to ensure hermetic sealing. This provides greater design flexibility for the plan of the labyrinth.

Further adhesion islands can also be used to provide better adhesion between the cover and the lid of the printer ink cartridge.

Figure 1:
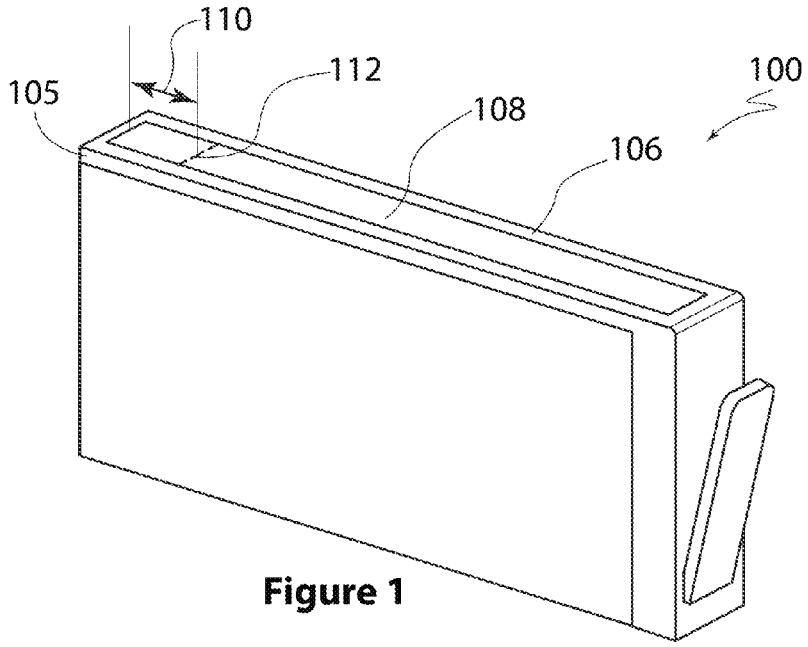
FIG. 1 is a perspective view of a printer ink cartridge.
Figure 2:
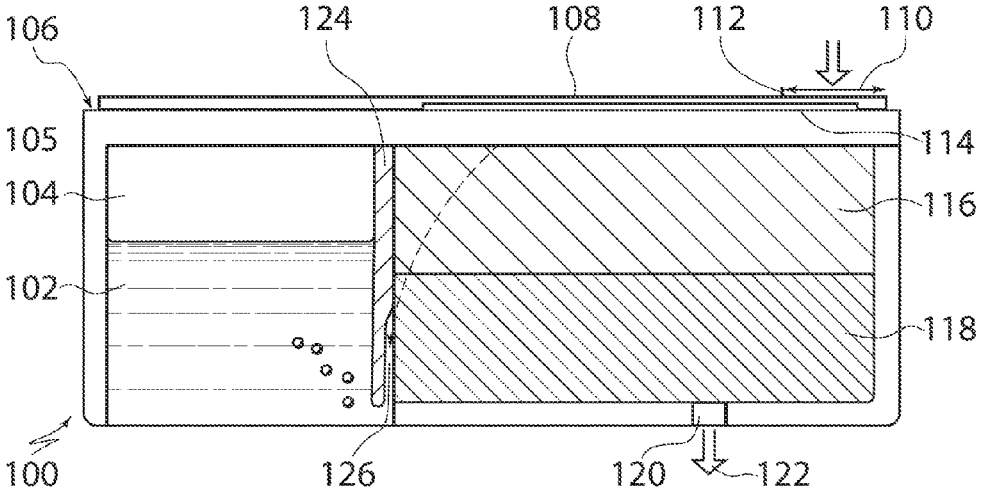
FIG. 2 illustrates the internal organisation of a printer ink cartridge of an example.

Referring first to FIGS. 1 and 2, the example printer ink cartridge 100 shown is of the type that is under negative pressure to retain liquid ink in a reservoir, but allows controlled ingress of atmospheric air for the ink to be released from the cartridge. Within the cartridge is a liquid ink reservoir 102 containing liquid ink, and above it is a chamber under negative pressure 104 that prevents the liquid ink from leaving the reservoir. In use, the pressure in the chamber 104 ranges between vacuum up to a point below ambient pressure. When the cartridge is acquired by the end user a surface 106 of the lid 105 of the cartridge that is intended to face upwards in normal use is substantially hermetically sealed by adhesion with a cover 108. In one example adhesion is by heat staking that uses a combination of heat and pressure to bond the cover to the lid. In another example, adhesion is by welding of plastics and polymer materials of the cover and lid. Part 110 of the cover 108 is removable by peeling back to a junction 112, being a pre-cut tear line. A labyrinth 114 is located immediately below cover 108 on the surface 106 of the printer ink cartridge 100. It is the surface of the labyrinth 114 that is hermetically sealed to the cover 108.

Immediately below the labyrinth 114 is a region of low capillary media 116 which holds ink relatively loosely. Below that is a region of high capillary media 118 which holds ink relatively tightly. In use, ink feeds from the region of high capillary 118 via a wick 120 to the print head, which is not shown but generally indicated by arrow 122.

A central wall 124 separates the ink 102 and chamber under pressure 104 from the regions of capillary media 116 and 118. The lower region of wall 124 parts from the region of high capillary media 118. As ink is withdrawn through the wick 120 the regions of capillary media 116 and 118 hold less ink. Air may pass through the capillary media, and eventually air can be drawn under the bottom 126 of wall 124 to bubble up into the ink reservoir to relieve the pressure 104 in the ink reservoir. This in turn allows liquid ink to enter the capillary media. In this way the cartridge is designed to provide a suitable flow of ink to the print head 122.

Before air can be drawn through the capillary media it passes through the labyrinth 114. When the cartridge 100 is acquired by the end user the surface 106 is hermitically sealed by cover 108, and before the cartridge can be used the removable part of the cover 110 is peeled back to the tear line 112. This opens the distal end of the labyrinth 114.

Figure 4:
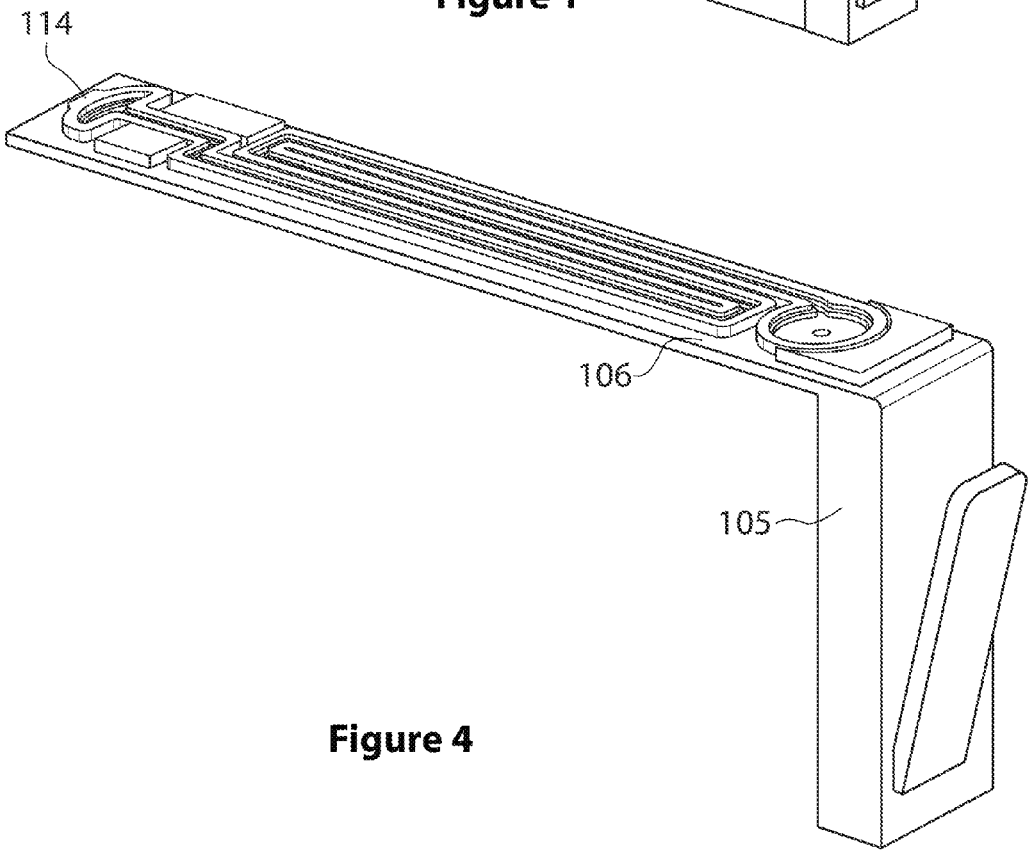
FIG. 4 is a perspective view of the lid of the printer cartridge.

The position of the labyrinth 114 of the upper surface 106 of the lid 105 of printer ink cartridge with the cover 108 completely removed is shown in FIG. 4. Labyrinth 114 will now be described in greater detail with reference to FIG. 3 which shows in plan view the surface 106 with the cover 108 completely removed.

Starting with the air entrance chamber 200 under the removable part 110 of the cover which is dumbbell shaped and surrounded by a raised track 202. The proximal end of the entrance chamber is curved. The inner edges of the entrance chamber 200 are stepped down forming a lower step 204. This reduces the area of contact between the entrance chamber 200 and the removable part 110 of the cover. The raised track 202 is at its widest 207 at the proximal end. The raised track 202, the lower step 204 and wider track point 207 assist in starting the peeling process of the removable part 110 of cover by providing a triggering point. Assisting the peeling helps to ensure that the removable part is successfully completely removed before deployment.

At the distal end of the entrance chamber 200 there is an exit 206 that opens into elongate channel 208 that forms a flat walled passageway having a horizontal base through which air flows downstream. The air flow is shown by the series of arrows, one of which is indicated at 209. The initial portion of the elongate channel 208 is straight and parallel to the length of the labyrinth 114. In this way the elongate channel 208 continues between two adhesion islands 210 and 212. The first 210 and second 212 adhesion islands provide a relatively large surface area for adhesion of the cover 108, such as by heat staking or welding. These islands 210 and 212 also abut against the outer edges of the elongate channel 208 that extends between them.

The junction 112 between the removable part of the cover 110 and the permanent part of the cover is a tear line that falls across the first 210 and second 212 adhesion islands.

A raised track 218 and 220 extends on the surface of the labyrinth 114 along both sides of the elongate channel 208. The interior surfaces of the walls of the elongate channel 208 are recessed along their inner edge to form a step 222 and 224 also extending along both sides of the elongate channel 208. The step 222 and 224 in part defines the raised track 218 and 220.

The elongate channel 208 then creates a meandering passageway that extends to the exit chamber 226 with the raised track and stepped inner edge on each side extending the length of the elongate channel 208.

For example the elongate channel 208 turns at a straight angle towards a side of the cartridge, perpendicular to the length of the labyrinth 114, for a relatively short distance, and then turns again at a straight angle, parallel to the side of the cartridge and the length of the labyrinth, away from the entrance chamber for a longer distance. The elongate channel 208 then has a first switch back 223, that is, turns back on itself a first time to head back towards parallel to the length of the labyrinth 114 to the entrance chamber 200. Then the elongate channel 208 has a second switch back 225, that is it turns back on itself a second time and extends parallel to the length of the labyrinth 114 all the way to the exit chamber 226.

The exit chamber 226 is circular. Within the exit chamber 226 is an entrance 228 that provides communication to the capillary media 116 and 118 and the associated liquid ink as shown in FIG. 21.

A raised track 234 also surrounds the exit chamber 226 and a recessed step 230 also extends around the inner edge of the circular exit chamber 226.

In an example, the raised tracks 202, 218, 220 and 234 are continuous to form a unitary raised track that surrounds the entrance chamber 200, elongate channel 208 and exit chamber 226 and therefore surrounds the labyrinth 114 itself. At the same time the inside edges of the walls of the entrance chamber 200, elongate channel 208 and exit chamber 226 can also be stepped 204, 222, 224 and 230 in a manner that is continuous and substantially uniform in size. Since the cover substantially adheres to the surface of the labyrinth 114, and not to the surface of the lower step, the cover adheres with the raised track to hermetically seal the labyrinth 114. The width of the raised tracks 202, 218, 220 and 234 is selected to provide adequate hermetic seal while accounting for variability in the manufacturing process of the labyrinth 114. Further the labyrinth 114 design also ensures adequate air flow through the labyrinth 114 to release the ink during use.

For example, a final adhesion island 232 is located adjacent and beyond the exit chamber 226 to anchor the distal end of the cover in conjunction with the raised tracks 218, 220 and 234.

Figure 5:
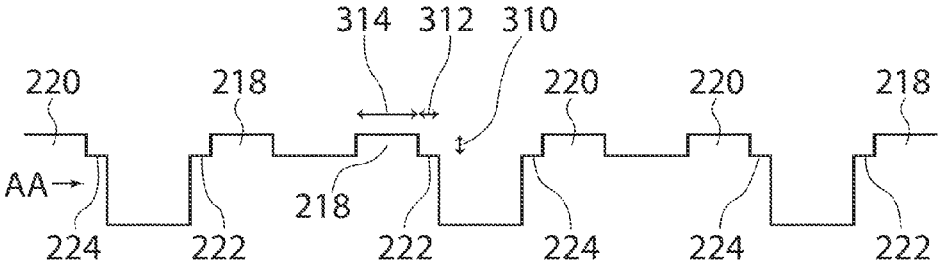
FIG. 5 is a cross-section through the labyrinth at AA-AA as marked on FIG. 3.
Figure 3:
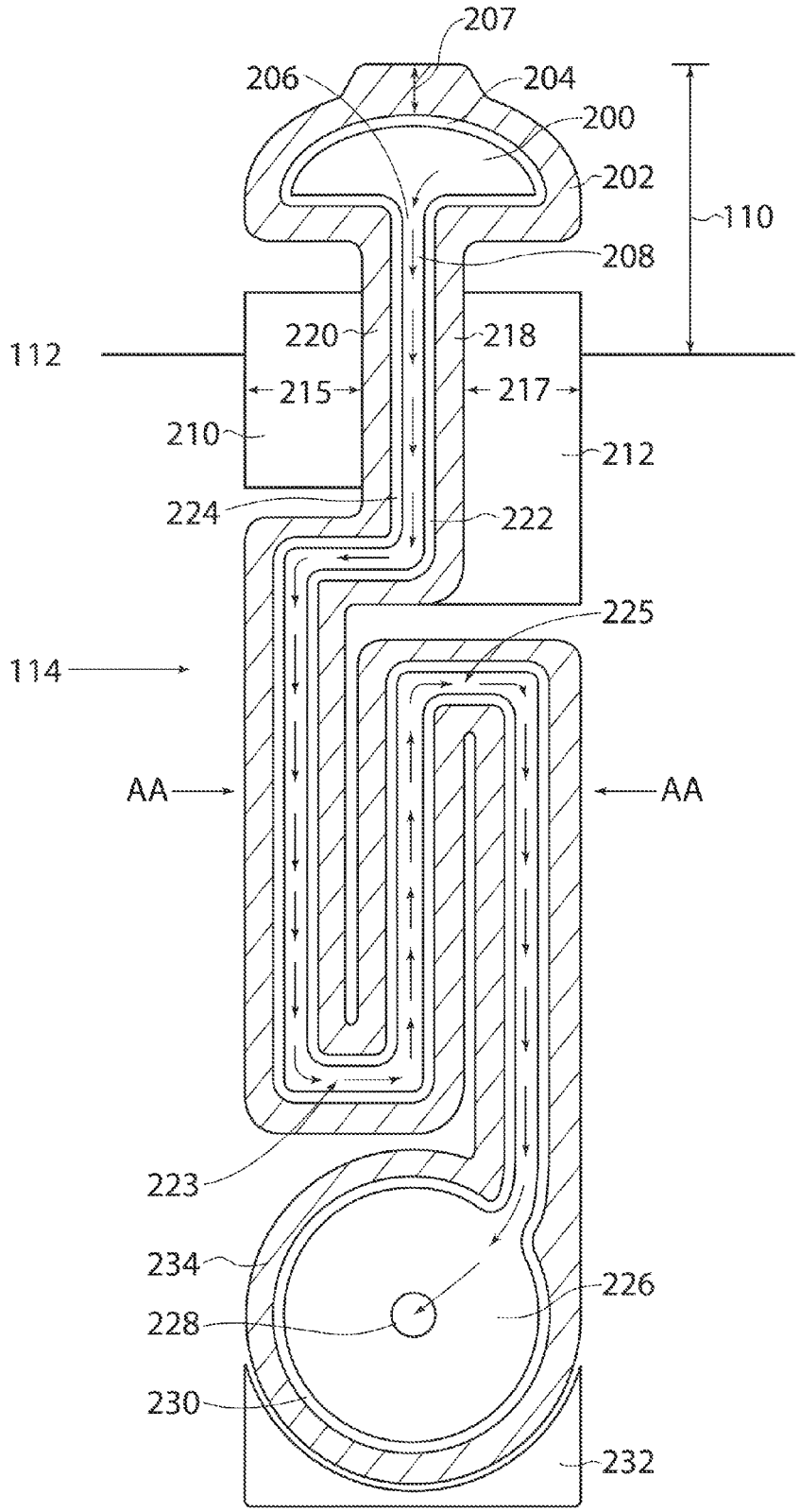
FIG. 3 is a plan view of a labyrinth of a printer ink cartridge.

The design of the raised track and stepped inner edges is shown in the cross-section through the labyrinth 114 at AA-AA as marked on FIG. 3. Since AA-AA includes the formation resulting from two switch backs the elongate channel is 208 has three cross sections in FIG. 5. Looking at the centre cross section the raised track height is identified at 310, the step width is shown at 312 and the track width is shown at 314. As can be seen in this diagram, the dimension of the raised tracks and inner steps are substantially uniform (allowing for manufacturing variations).

In one example, the design has the following specification with a possible range of values also provided in brackets:

| | |
|---|---|
| Labyrinth length | 56.92 mm (30-80 mm) |
| Adhesion area | 102.53 mm2 (30-200 mm2) |
| Number of Islands | 3 (1-5) |
| Area of Islands | 34.04 mm2 (10-80 mm2) |
| Labyrinth cross section | 0.3 mm2 (0.150-0.60 mm2) |
| Raised track height | 120 um (50-500 um) |
| Raised track width | 600 um (150-900 um) |
| Step (ledge) width | 200 um (50-400 um) |
| Air volume in labyrinth | 46.85 mm3 (20-120 mm3) |

It will be appreciated by persons skilled in the art that numerous variations and/or modifications may be made to the above-described examples, without departing from the broad general scope of the present disclosure. The present examples are, therefore, to be considered in all respects as illustrative and not restrictive.

What is claimed is:

1. A printer cartridge, comprising:

a labyrinth on a surface of the printer cartridge to provide controlled ingress of atmospheric air, the labyrinth having an entrance chamber to allow entry of atmospheric air, an exit chamber in communication with a liquid, and an elongate channel extending between the entrance chamber and the exit chamber, the elongate channel having a raised track formed on the surface and extending along each side of the elongate channel.

2. A printer cartridge according to claim 1 further comprising a cover to hermetically seal the labyrinth including sealing with the raised track.

3. A printer cartridge according to claim 1 wherein the raised track comprises a step along the inner edges of the elongate channel.

4. A printer cartridge according to claim 1 wherein the width of the raised track provides a suitable surface area to form the hermetic seal.

5. A printer cartridge according to claim 1 further comprising a first and second adhesion islands on opposite sides of the elongate channel adjacent the entrance chamber.

6. A printer cartridge according to claim 5 wherein the cover includes a junction defining a removable part of the cover that when removed opens the entrance chamber to atmospheric air, and the junction is positioned between the first and second adhesion islands.

7. A printer cartridge according to claim 1 further comprising a third adhesion island adjacent the exit chamber.

8. A printer cartridge according to claim 1 wherein the raised track is unitary and surrounds the labyrinth.

9. A printer cartridge according to claim 1 wherein the entrance chamber is dumbbell-shaped in plan.

10. A printer cartridge according to claim 1 wherein a step extending along the inner edge of the entrance chamber and the exit chamber.

11. A printer cartridge according to claim 1 wherein the elongate channel between the entrance chamber and the exit chamber includes two switch backs.

12. A printer cartridge according to claim 11 wherein the switch backs connect to elongate channel portions that are parallel to length of the labyrinth.

13. A printer cartridge according to claim 1 wherein the width of the raised track is 600 um.

14. A printer cartridge according to claim 2 wherein the step has a height of 150 um.

15. An upper surface of a printer cartridge that is under negative pressure to retain liquid and allows controlled ingress of atmospheric air, the upper surface comprising:

a labyrinth formed with an entrance chamber to allow entry of atmospheric air, an elongate channel extends from the entrance chamber downstream with at least two switchbacks and terminating in an exit chamber which communicates with the liquid, wherein the elongate channel incorporates a longitudinally extending step along one or both inner edges of the elongate channel.

* * * * *